US005691533A

United States Patent [19]

Freeman et al.

[11] Patent Number: 5,691,533

[45] Date of Patent: Nov. 25, 1997

[54] METHOD AND APPARATUS FOR THE DETECTION OF THE LOCATION OF MULTIPLE CHARACTER MARKS

[75] Inventors: Dennis R. Freeman, Spencerport; Warren Kosel, Penfield; Thomas E. Phillips, Brockport, all of N.Y.

[73] Assignee: Eastman Kodak Company, Rochester, N.Y.

[21] Appl. No.: 560,556

[22] Filed: Nov. 17, 1995

[51] Int. Cl.[6] ..... G01N 21/89

[52] U.S. Cl. ..... 250/222.1; 250/557; 250/559.47

[58] Field of Search ..... 250/557, 555, 250/559.47, 222.1; 226/45

[56] References Cited

U.S. PATENT DOCUMENTS

| | | | |
|---|---|---|---|
| 2,928,949 | 3/1960 | Steinbuch | 250/206 |
| 3,700,909 | 10/1972 | Murray et al. | 250/559.47 |
| 4,249,081 | 2/1981 | Cole et al. | 250/563 |
| 4,293,774 | 10/1981 | Pongracz | 250/557 |
| 4,389,575 | 6/1983 | Cole | 250/563 |
| 5,095,219 | 3/1992 | Laumann et al. | 250/557 |

*Primary Examiner*—Edward P. Westin
*Assistant Examiner*—Kevin Pyo
*Attorney, Agent, or Firm*—Arthur H. Rosenstein

[57] ABSTRACT

This invention pertains to a detection system for locating and counting identification marks attached to a written or printed item. A signal processing method and apparatus is described which allows detection of multiple character marks as a single event in continually moving linear materials. The marks are passed between the path of a detection zone comprising a light source and a photodetector to precipitate a voltage drop and feeding that drop to a circuit that recognizes the drop and simultaneously triggers a time window during which changes in voltage are ignored, which time window is no longer than the time it takes for a full mark to pass under the zone and shorter than the time it takes for the leading edge of the next multicharacter marks to reach the detection zone.

11 Claims, 2 Drawing Sheets

METHOD AND APPARATUS FOR THE DETECTION OF THE LOCATION OF MULTIPLE CHARACTER MARKS

FIELD OF THE INVENTION

The present invention relates to a signal processing method to detect, locate and/or count multiple character marks on a continuously moving multiple character marked linear material. The method and apparatus allow for recognition of marks for the purpose of counting or locating them. The process and apparatus can be used to locate or count items on photographic film strips or other materials.

BACKGROUND OF THE INVENTION

In the case of manufacturing films such as photographic films it is often required to locate and/or count bar-coded or other marked locations on the film strip, for instance, multi-character codes are used to identify the end of an individual unit and the use of marks will not only count the number of images, but locate particular images for further copying or for correction of defects.

Various methods have been suggested in the prior art for locating and counting marks on an inclusive item. In one arrangement, items such as images are fed past a photoelectric scanning device in which the scanning beam sweeps forwardly and backwardly vertically in relation to the direction in which the images travel. As soon as the identification mark is hit by the scanning beam, there is produced in the scanning device, by a photocell, an intensity fluctuation which is then used to identify the location of the marks and to count the marks. Items such as photographic images can be scanned for identification of defects such as described in U.S. Pat. No. 4,389,575. Other defect detection systems are shown in U.S. Pat. No. 4,249,081 wherein a window is used to detect defects per unit. In U.S. Pat. No. 2,928,949 an apparatus for locating an identification mark uses a window to determine margins on printed matter.

During web coating or treatment it is advantageous to know the precise location of the web in relationship to changes in coating or treatment conditions. To allow this, the web or an edge of the coated or treated web must have visible transparency. One can use marks from an Ink Jet Printer or other method to mark the web as distance measures. By passing these marks between the path of a light source and a photo-detector a voltage drop will be registered whenever a dark mark passes under the detector. This voltage drop can be fed to a circuit that will recognize it and count it as one event. This system of detection and counting works well when marks are simple bars or single characters, since then each mark produces only one voltage drop as it passes through the detector zone.

The problem, thus, is that these methods of coating or locating multicharacter marks is inaccurate as multiple character events are read or counted as multiple events and not a single occurrence.

SUMMARY OF THE INVENTION

During web coating or treatment it is advantageous to know the precise location of the web in relationship to changes in coating or treatment conditions. To allow this, the web or an edge of the coated or treated web must have visible transparency. One can use marks from an Ink Jet Printer or other method to mark the web as distance measures. By passing these marks between the path of a light source and a photo-detector a voltage drop will be registered whenever a dark mark passes under the detector. This voltage drop can be fed to a circuit that will recognize it and count it as one event. This system of detection and counting works well when marks are simple bars or single characters, since then each mark produces only one voltage drop as it passes through the detector zone. The present invention overcomes this limitation by processing the signal in the following way: When a voltage drop takes place as the leading edge of a multiple-character mark enters the detection zone the circuit counts one event and simultaneously triggers a time-window during which changes in voltage will be ignored and not counted as events. The duration of this time window is chosen to be longer than the time it takes for a full multicharacter mark to pass under the detection zone and shorter than the time it takes for the leading edge of the next multicharacter mark to reach the detection zone. It is evident that a multiple character mark can be seen and counted as a single event by combining a light source and photo-detector. This is done when a voltage drop is detected as an optical density increase with a detector circuit that can comprise a timing window which sets the time interval of the voltage drop to recognize events of a specific duration. The time constant window can be adjusted to accommodate differing character lengths or adjusted to allow slower or faster web speeds. This would include a combination of the two variables: character length or web speed. Therefore, the event-counter can work at high or low web speed merely by changing the time-constant window. The event-counter can be used for a) counting marks preprinted on a web as a means of measuring position/location, b) detecting defects on web related to pinholes, cracks, deposition anomalies etc., c) detecting locations on a web when coatings/treatments should start/end. The event counter can count forwards or backwards via a selectable switch and can be set to any desired "start" number by a second switch. This allows direct readout (outboard of the vacuum chamber) of web footage location, thereby allowing precise knowledge of treatment zone locations. Accordingly, the counter could be set to a predetermined number of "events"/"defects" etc. and allowed to count backwards to know when the limit/end point had been reached.

BRIEF DESCRIPTION OF THE DRAWINGS

The aforementioned advantages of the invention will be appreciated from the following description and accompanying drawings wherein.

DETAILED DESCRIPTION OF THE PREFERRED EMBODIMENTS

Figure 1:
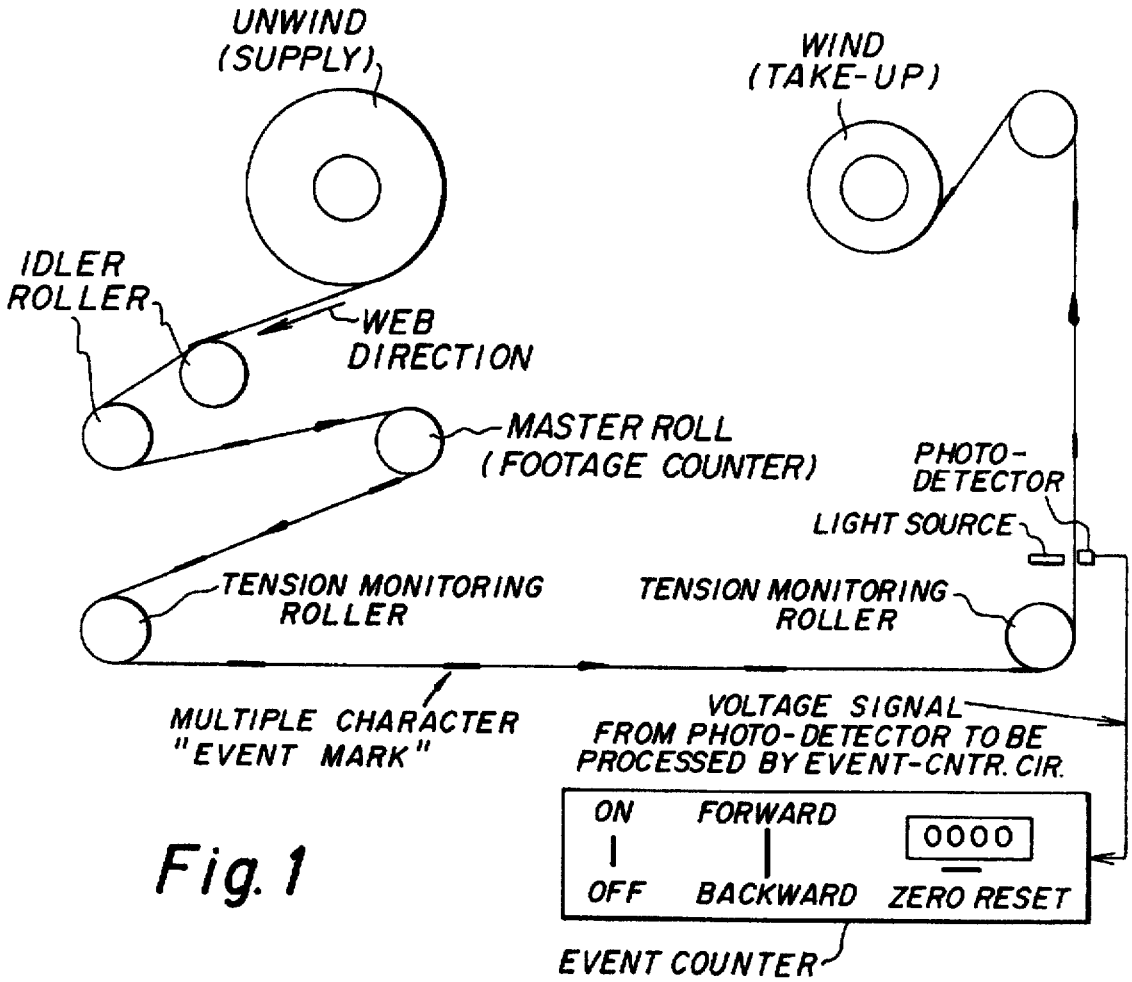
FIG. 1 is a schematic of the system that makes use of the event counter.

In FIG. 1, a representation of the system that makes use of the event counter or locator is shown. As seen in FIG. 1, a continuously moving multicharacter marked linear material is positioned on the supply roll to be unwound. The linear material can comprise a sheet or web of any material to be subjected to either a counting or identifying process. Thus, the material may be a photographic web containing a number of images, a fabric wherein defects are to be counted, a web with footage/location/I.D. character sets or the like. The linear material which can contain images or other coatings thereon are preferably formed from either paper, fabric or polymeric films such as polyethylene terephthalate (PET), polyethylene napthalate (PEN) and the like.

The linear material can be marked with multicharacter marks by using conventional techniques such as ink jet printer, bubble jet printer, or other character writing devices.

Many marks are multicharacterized, rather than comprise a single character, thus allowing material type I.D., footage/location I.D., manufacturing date and/or location or other useful and relevant information in the character set.

The marked linear material is wound from the supply roll and wound over idler rollers in the direction indicated on FIG. 1. The idler rollers direct web path and insure sufficient contact to the master drive.

The linear material is then wound past a master roll (footage counter) which is the drive roll controlling web speed.

The linear material is shown passing over a tension monitoring roller which controls the unwind tension of material.

The multiple character event mark is then applied at the desired sequences on the material before the material is passed over another tension monitoring roller which controls the wind tension. The web may also be marked offline on a web rewinder.

The continually moving material which is marked with multiple character marks is then passed between the path of a detection zone comprising a light source and a photo-detector which are shown as being on opposite sides of the linear material but can be on the same side at complimentary angles. The sensing apparatus includes an infrared light source illuminating the portion of the linear material being sensed by infrared light detecting means. The detecting means consists of a block having a plurality of light receiving openings defined therein, and a sensitive, electronic, infrared, light detector being located adjacent to each light passage wherein the passing of a mark past a portion reflecting light into a given passage will cause a variation in the amount of light reflected into that passage producing an electronic variation in the light receiving sensor to produce an electronic signal.

The electronic signal produced due to a defect passing the sensor is amplified, compared with a background control signal, filtered, and electronically counted.

If the light source and photo-detector are not on opposite sides of the continuously moving linear material, as shown, they may be on the same side of the linear material, but at complimentary angles allowing the reflection of light, from the directed beam to be collected by the detector to achieve the same affect.

The electronic counting or locating apparatus shown as the event counter in FIG. 1 is also associated with an electronic timer (not shown) whose time frame is initiated by the first counted defect being sensed, and as subsequent events are signaled during an initiated time frame such defects are not counted. The electronic timer includes means for varying the duration of the time frame during which events are counted.

Figure 2:
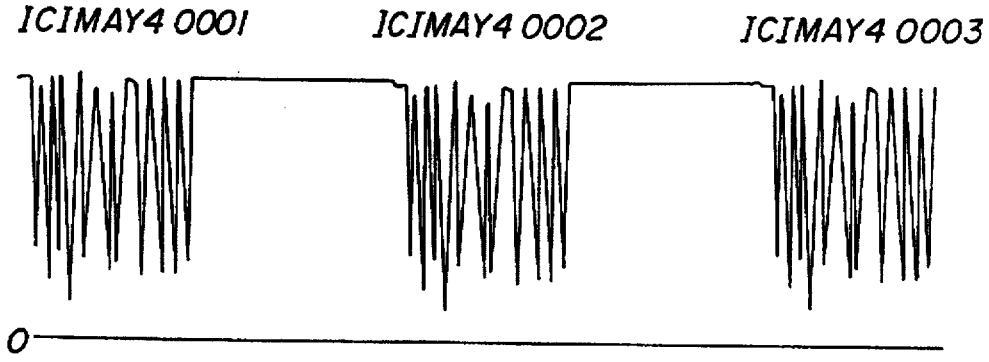
FIG. 2 is an illustration of how the event is registered by the light source/photo-detector arrangement.

FIG. 2 is an explanation of how the event is registered by the light source/photo-detector arrangement. A "time-window" can be set so that only an event of a specified duration is counted. If the event takes less than the specified "window" it is not counted. Thus, irregularities etc. are not counted unless wanted. In that case the "time-window" would be set to include them as "counts" (events). With a specific event length and a specific web speed range the multiple character events will be counted as one event. If the event length is changed or web speed changed to be outside the originally specified speed range then a new "time-window" can be set for the event counter circuit.

The circuit of the detection system of the invention as seen in FIG. 2, assures that the multiple character event is counted or identified as only one (1) event. Therefore, the three "sets" of characters indicated alpha numerically and graphically are counted as only three (3) events and not 33 (the total number of actual characters.

As seen in FIG. 1, the event counter or identifier can be equipped with a preset button to match the marks on the linear material and the event counter or locator can be adjusted to count up or down, at fast or slow speed which allows for adjustment of the speed of the continuously moving linear material.

As shown in FIG. 1, a light source is directed at a photo-detector, positioned such that printed character-sets pass between them, which converts the light signal to a voltage (0–15 V, adjustable). The voltage signal is adjusted to be 10 V with the unmarked web between the light source and photo-detector. As a printed character-set passes between the light source and photo-detector arrangement a voltage drop occurs, causing a time-window to be initiated. If the voltage drop is of sufficient duration this voltage drop is counted as an event. If the duration is too short (e.g. not a character-set, but some anomalous dirt, smudge or other mark) the voltage perturbation is of too short a duration or the delta voltage drop is too small to be accepted as a timed event. Thus only voltage drops of the appropriate amplitude and duration (this time window/level is set with the character-set length and linear speed in mind) are counted as "events". So, "non-event" caused voltage drops are ignored. This time-window can be set for a wide range of character-lengths and transport speeds. Once "set", the system can operate over a large range (example: A standard 12 character-set, set for 30 feet per minute transport speed is functional over 8–52 fpm).

Figure 3:
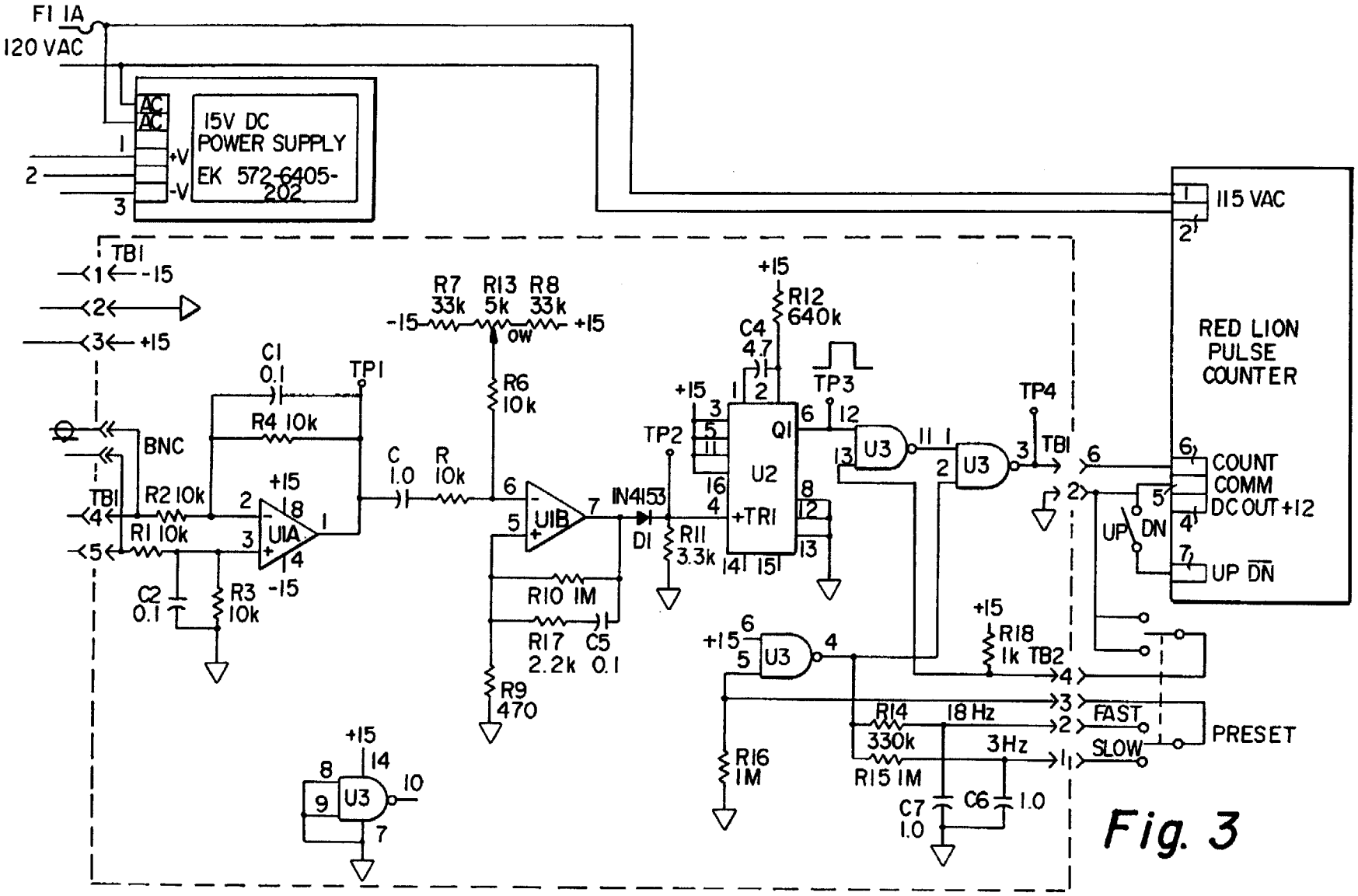
FIG. 3 is a circuit diagram of the event counter.

In the circuit diagram of FIG. 3, input from the detector is fed into U1A which provides buffering and differential amplification. The output from U1A is capacitively coupled into U1B through C3. U1B provides amplification and selectivity by off-setting the signal above noise levels. The output of U1B is negatively clipped by D1 and fed into U2. U2 is a one-shot oscillator which stretches the signal to 850 msec pulses allowing a Red Lion pulse counter to detect the pulses and count them. U3 provides gating to allow the preset oscillator to input pulses in place of the signal pulses. The present oscillator can be selected to run slow (3 hertz) or fast (18 hertz). The preset switch allows the operator to preset the counter to any number before initiating the count up or down sequence. The up-down switch determines which direction the counter will count.

Using the apparatus as shown allows a web or other conveyed material (the same thing can be done with reflection as well as transmission of light to a photo-detector) to be transported and length, patterns etc. kept track of. This allows a predetermined length or number of patterns to be collected before starting the next batch or: to do multiple experimental treatments on a length of web. By keeping track of the location (start/end) of each experimental run, multiple runs can be processed and the entire roll of web taken to another area for further processing. It will be known what regions are to receive additional processing as well as what regions to pull samples from for testing and evaluation. So, by using marked web and keeping track of the web length with the event counter, vacuum processing or other "out-of-sight" processing can be done with subsequent treatments done to known regions of the processed material. The multiple character events are necessary to allow footage (length) numbers as well as I.D. indication (in our case alpha-numeric). Because the first step of the processing is done in a vacuum chamber with no direct view of the conveyed material it is important (to improve process time/productivity and to cut down on the amount of material used) that a technique be developed that would allow tracking the conveyed material while being processed in the vacuum chamber.

While the invention has been described with particular reference to a preferred embodiment, it will be understood by those skilled in the art that various changes can be made and equivalents may be substituted for elements of the preferred embodiment without departing from the scope of the invention. In addition, many modifications may be made to adapt a particular situation with regard to a teaching of the invention without departing from the essential teachings of the present invention.

We claim:

1. A signal processing method to allow detection of the location of multiple character marks on a linear material as a single event comprising applying multiple character marks on the material and continuously moving the multiple character marked linear material in the path of a detection zone, said detection zone comprising a light source and a photodetector which detects a voltage drop as a mark enters the detection zone, feeding said voltage drop to a circuit that registers the voltage drop as an event, said registration simultaneously triggering a time window during which changes in voltage are ignored and not counted or marked as an event, the duration of the time-window being longer than the time it takes for a full character mark to pass under the detection zone and shorter than the time it takes for the leading edge of the next multicharacter mark to reach the detection zone.

2. The method of claim 1 wherein the multiple character marks are counted.

3. The method of claim 1 wherein the multiple character marks are located.

4. The method of claim 1 wherein the continuously moving linear material is a photographic web.

5. An apparatus for detecting the location of multiple character marks as a single event comprising means for applying multiple character marks on a linear material and means for continuously moving said linear material containing said marks into a detection zone, the detection zone comprising a light source and a photodetector located on either side of the linear material, the photodetector being connected to a circuit which registers a voltage drop as a mark enters the detection zone, said circuit being connected to a means for simultaneously triggering a time window during which changes in voltage are ignored and not counted or marked as an event, the duration of the time window being longer than the time it takes for a full character mark to pass under the detection zone and shorter than the time it takes for the leading edge of the next multicharacter marks to reach the detection zone.

6. The apparatus of claim 5 wherein the detection zone comprises a light source and a photodetector are on the same side of the linear material, but at complimentary angles.

7. The apparatus of claim 5 wherein the multiple character events are counted.

8. The apparatus of claim 5 wherein the multiple character events are located.

9. The apparatus of claim 5 wherein the time-window reflects the speed of the continuously moving linear material.

10. The apparatus of claim 9 whereas the time window is adjustable, reflecting the speed of continuously moving linear material to a desired speed.

11. The apparatus of claim 5 wherein the event counter has a preset button to match the marks on the loaded roll of material, said event counter being adjusted to count up, or down, and at fast or slow speeds which allows for adjustment and the speed of a continuously moving web.

* * * * *